US010328561B1

(12) United States Patent
Weinberger et al.

(10) Patent No.: US 10,328,561 B1
(45) Date of Patent: Jun. 25, 2019

(54) COMPANION MULTI-TOOL

(71) Applicant: MIW Associates, LLC, Havertown, PA (US)

(72) Inventors: Marvin Weinberger, Havertown, PA (US); Steven Metzner, Havertown, PA (US); Todd M. Hertaus, New Market, MN (US); Nicholas J. Teigland, Mankato, MN (US)

(73) Assignee: MIW Associates, LLC, Havertown, PA (US)

( * ) Notice: Subject to any disclaimer, the term of this patent is extended or adjusted under 35 U.S.C. 154(b) by 232 days.

(21) Appl. No.: 15/589,449

(22) Filed: May 8, 2017

Related U.S. Application Data

(60) Provisional application No. 62/332,697, filed on May 6, 2016.

(51) Int. Cl.
*B25F 1/04* (2006.01)
*F23Q 1/02* (2006.01)
*B24D 15/08* (2006.01)

(52) U.S. Cl.
CPC ..... *B25F 1/04* (2013.01); *B24D 15/08* (2013.01); *F23Q 1/02* (2013.01)

(58) Field of Classification Search
CPC ..... F23Q 1/02
USPC ..... 7/120, 158, 168
See application file for complete search history.

(56) References Cited

U.S. PATENT DOCUMENTS 4,882,841 A * 11/1989 Margolis ..... B26B 11/001 30/125
6,223,372 B1 * 5/2001 Barber ..... B25F 1/00 7/118
6,782,576 B1 * 8/2004 Valencic ..... B24D 15/06 7/158
8,015,643 B2 * 9/2011 White ..... A62B 3/005 7/144
9,296,587 B2 * 3/2016 Gonzalez ..... D07B 7/16
9,833,880 B1 * 12/2017 Dovel ..... B24D 15/08
2012/0098282 A1 * 4/2012 Langan ..... B25F 1/006 294/49

* cited by examiner

*Primary Examiner* — Hadi Shakeri
(74) *Attorney, Agent, or Firm* — Moss & Barnett; Michael A. Bondi

(57) ABSTRACT

A companion multi-tool that includes an elongated body, a blade sharpening cavity, a sharpening element, a tinder material, a flint material, a noise generating material and a clip. The elongated body has a first end and a second end. The blade sharpening cavity is formed in the elongated body proximate the first end thereof. The sharpening element is attached to the elongated body in the blade sharpening cavity. The tinder material is attached to the elongated body. The flint material is attached to the elongated body. The noise generating device is formed in the elongated body proximate the second end thereof. The clip is attached to the elongated body intermediate the first and second ends.

15 Claims, 3 Drawing Sheets

COMPANION MULTI-TOOL

REFERENCE TO RELATED APPLICATION

This application claims priority to Provisional Applic. No. 62/332,697, filed on May 6, 2016, the contents of which are incorporated herein by reference.

FIELD OF THE INVENTION

The invention generally relates to hand tools. More particularly, the invention relates to multi-function hand tools.

BACKGROUND OF THE INVENTION

When performing various recreational activities such as hiking and camping, it is often necessary to perform certain tasks that require tools such as cutting objects, starting a fire and identifying a direction of travel. However, when hiking and camping, it is often necessary to the person to carry such tools with him or her. As such, it is desired for the tools carried while hiking and camping to have as many functions as possible while being as light and easy to transport as possible.

SUMMARY OF THE INVENTION

An embodiment of the invention is directed to a companion multi-tool that includes an elongated body, a blade sharpening cavity, a sharpening element, a tinder material, a flint material, a noise generating material and a clip. The elongated body has a first end and a second end. The blade sharpening cavity is formed in the elongated body proximate the first end thereof. The sharpening element is attached to the elongated body in the blade sharpening cavity. The tinder material is attached to the elongated body. The flint material is attached to the elongated body. The noise generating device is formed in the elongated body proximate the second end thereof. The clip is attached to the elongated body intermediate the first and second ends.

Another embodiment of the invention is directed to a companion multi-tool that includes an elongated body, a blade sharpening cavity, a sharpening element, a tinder material, a flint material and a noise generating device. The elongated body has a first end and a second end. The elongated body has a first edge surface and a second edge surface that both extend between the first and second ends of the elongated body on opposite edges of the elongated body. The first and second edge surfaces each include a first end region, a second end region and a recessed region. The first end region is proximate the first end. The second end region is proximate the second end. The recessed region is between the first and second end regions. The recessed region is recessed below at least one of the first and second end regions. The blade sharpening cavity is formed in the elongated body proximate the first end thereof. The sharpening element is attached to the elongated body in the blade sharpening cavity. The tinder material is pivotally attached to the elongated body on the first edge surface. The flint material is pivotally attached to the elongated body on the second edge surface. The noise generating device is formed in the elongated body proximate the second end thereof. The respective tinder and flint material is recessed below the first and second end regions when in a retracted configuration.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
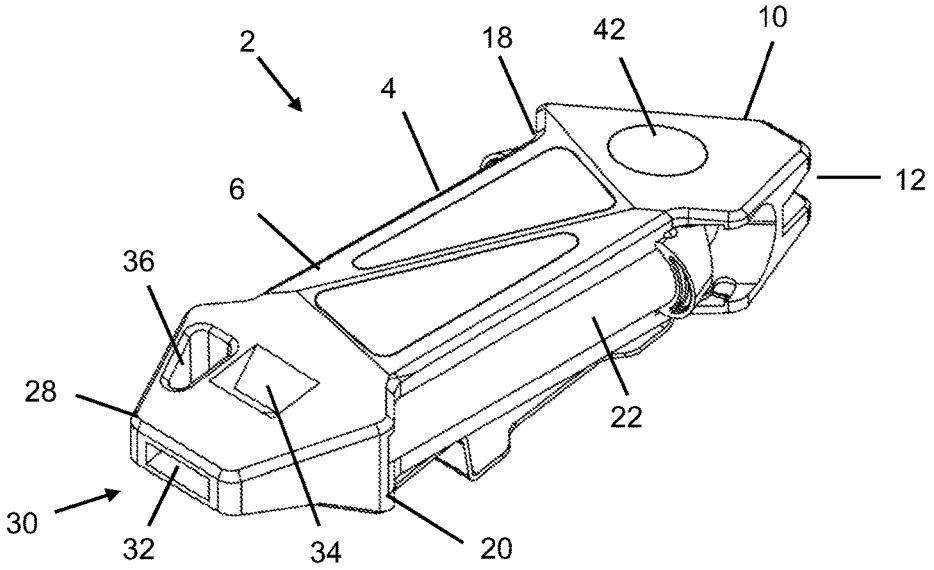
FIG. 1 is a perspective view of a companion multi-tool according to an embodiment of the invention with a tinder material and a flint material in a retracted configuration.
Figure 2:
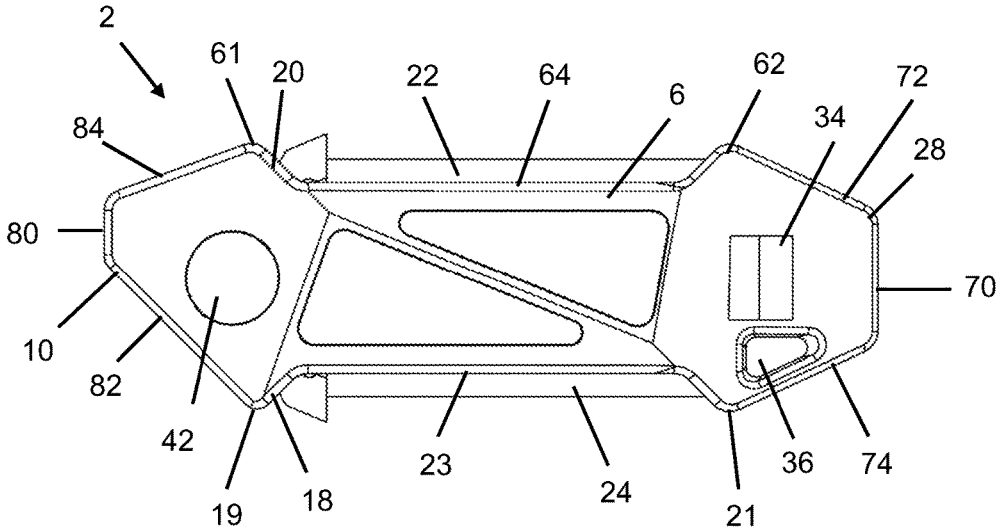
FIG. 2 is a front view of the companion multi-tool.
Figure 3:
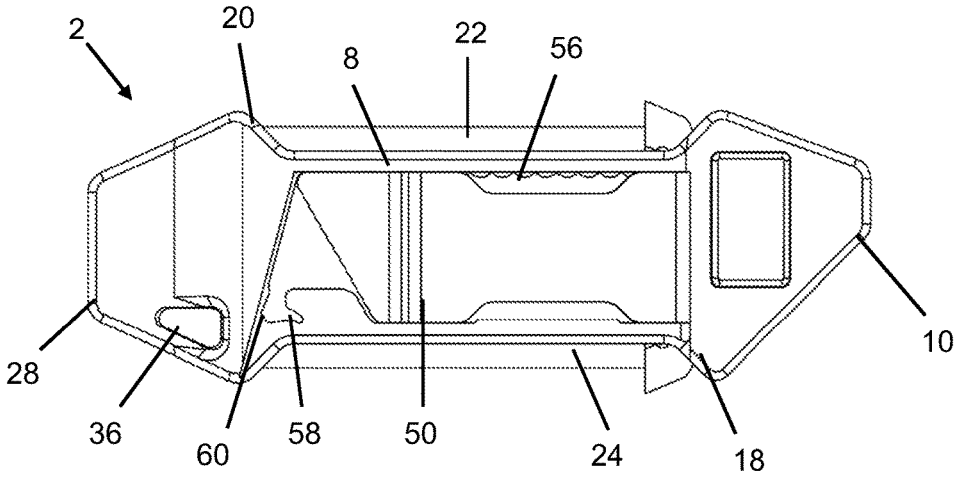
FIG. 3 is a back view of the companion multi-tool.
Figure 4:
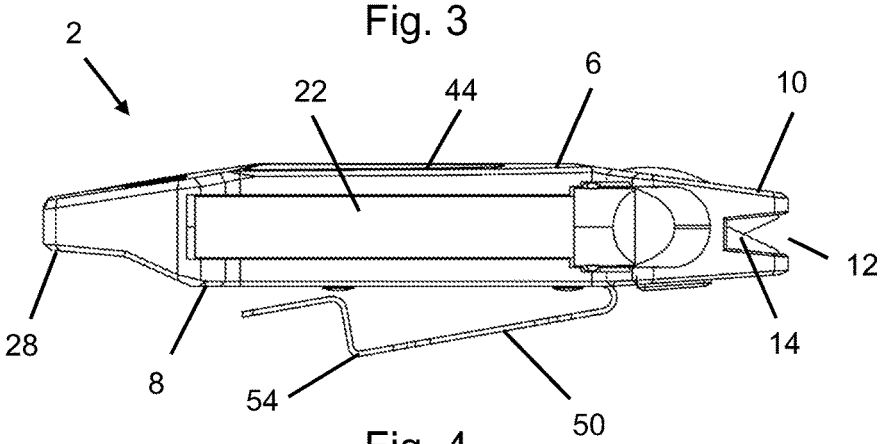
FIG. 4 is a side view of the companion multi-tool.
Figure 5:
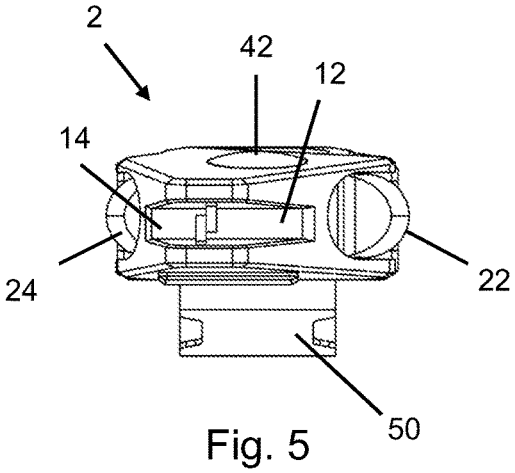
FIG. 5 is a first end view of the companion multi-tool.
Figure 6:
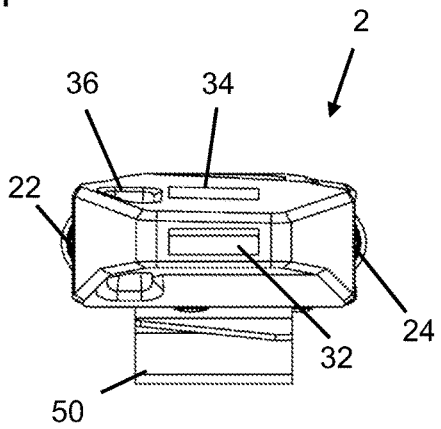
FIG. 6 is a second end view of the companion multi-tool.

In various embodiments, a companion multi-tool is disclosed. The companion multi-tool includes a body defining a predetermined thickness extending between an upper longitudinal surface and a lower longitudinal surface. The body defines a sharpening cavity at a first end.

A sharpener is operatively disposed within the sharpening cavity. The sharpening cavity is sized and configured to receive a blade therein. The body further defines a first longitudinal cavity extending from a first side of the body into the body and a second longitudinal cavity extending from a second side of the body into the body. A fire-starting tinder material is disposed in the first longitudinal cavity and a flint is disposed in the second longitudinal cavity. In some embodiments, a second end of a body defines a whistle.

FIGS. 1-6 illustrate an embodiment of a companion multi-tool 2. The companion multi-tool 2 includes a body 4 defining an upper longitudinal surface 6 and a lower longitudinal surface 8. The body 4 has a predetermined thickness between the upper longitudinal surface 6 and the lower longitudinal surface 8.

In some embodiments, the thickness of the body 4 is selected to accommodate one or more accessories coupled thereto. The body 4 can include any suitable regular and/or irregular body shape, such as, for example, a geometric shape.

In some embodiments, a first end 10 of the body 4 defines a sharpener cavity 12. The sharpener cavity 12 is sized and configured to receive a blade therein. For example, the sharpener cavity 12 can be sized and configured to receive a knife blade, an axe blade, a hatchet blade, and/or any other suitable blade. In some embodiments, the sharpener cavity 12 is configured to receive irregular blades, such as curved blades, therein.

A sharpening element 14 is disposed within the sharpener cavity 12 and positioned to sharpen a blade passed through the sharpening cavity 12. Although a single sharpener cavity 12 having a single sharpening element 14 is illustrated, it will be appreciated that the body 4 can define any number of sharpening cavities containing any number of sharpening elements 14 therein.

Proximate the first end 10, the elongated body 4 may include an end surface 80 that is intermediate a first end edge surface 82 and a second end edge surface 84. The first and second end edge surfaces 82, 84 are both oriented at an obtuse angle with respect to the end surface 80. In certain embodiments, the obtuse angle is between about 90 degrees and about 135 degrees.

Orienting the first end edge surface 82 at an angle that is different than the second end edge surface 84 may be useful in assisting a person using the sharpening element 14 to remember a preferred direction in which the blade is moved with respect to the sharpening element 14 during the sharpening process. While it is illustrated that the angle between the end surface 80 and the first end edge surface 82 is different than the angle between the end surface 80 and the second end edge surface 84, it is possible for these angles to be the same.

Orienting the first and second end edge surfaces 82, 84 at an obtuse angle with respect to the end surface 80 enhances the ability of the person to position a blade that is being sharpened using the sharpening element 14 in a wide range of angles with respect to the companion multi-tool 2. Contact of the blade with surfaces on the companion multi-tool 2 other than the sharpening element 14 may not only impede the sharpening process but also could damage the blade that is being sharpened.

Such a configuration facilitates mounting the sharpening element 14 at a recessed location in the companion multi-tool 2 so that the sharpening element 14 is not inadvertently contacted while the companion multi-tool 2 is stored or while other functionality of the companion multi-tool 2 is being used.

In some embodiments, the body 4 defines one or more longitudinal cavities along at least one of the first and second sides 18, 20 thereof. For example, in the illustrated embodiment, the body 4 includes a first longitudinal cavity extending from a first longitudinal side 18 of the body 4 and a second longitudinal cavity extending from a second longitudinal side 20 of the body 4.

The longitudinal cavities are sized and configured to receive at least a portion of one or more accessory elements therein. For example, in the illustrated embodiment, a tinder material 22 is received within the first longitudinal cavity and a flint material 24 is received within the second longitudinal cavity. The tinder material 22 can be any material configured for starting and/or assisting in starting a fire, such as, for example, magnesium.

The flint material 24 can be any material configured to provide a spark when struck with a striker (see FIG. 2B), such as, for example, a ferrocerite material. In some embodiments, the body 4 defines a replacement notch sized and configured to allow removal and/or insertion of one or more accessory elements inserted into the longitudinal cavities.

Figure 7:
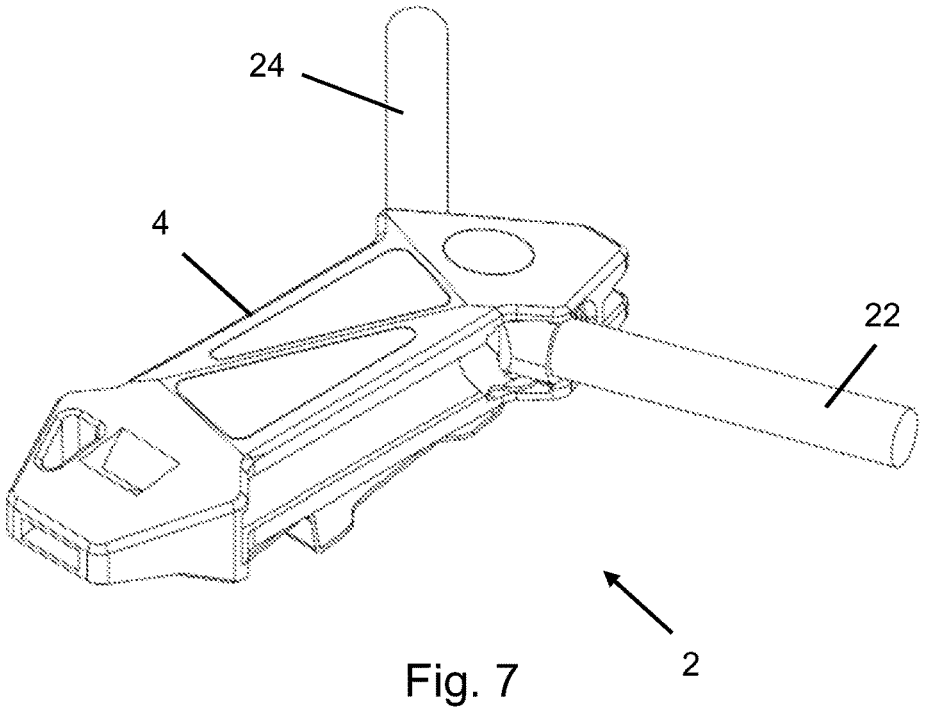
FIG. 7 is a perspective view of the companion multi-tool with the tinder material and the flint material in an extended configuration.
Figure 8:
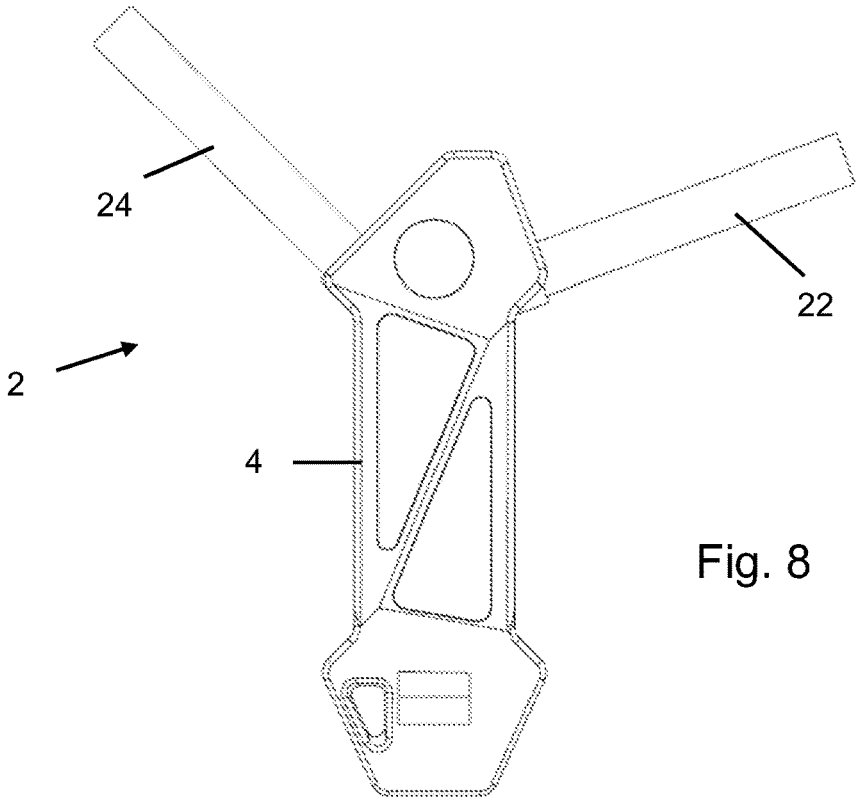
FIG. 8 is a top view of the companion multi-tool with the tinder material and the flint material in the extended configuration.

Proximate the intersection of the tinder material 22 and the body 4, an extension may extend from the surface of the tinder material 22. The extension may enhance the ability to move the tinder material 22 from the retracted configuration (FIGS. 1-6) to the extended configuration (FIGS. 7-8).

Proximate the intersection of the flint material 24 and the body 4, an extension may extend from the surface of the flint material 24. The extension may enhance the ability to move the flint material 24 from the retracted configuration (FIGS. 1-6) to the extended configuration (FIGS. 7-8).

The longitudinal cavities can include one or more additional and/or alternative accessories coupled thereto/located therein. For example, in various embodiments, accessories can include a scraper, a serrated blade, a knife blade, a fish gutter, one or more screwdrivers, fishing line, a sharpening stick, and/or any other suitable accessories.

The first side 18 includes a first side end region 19, a second side end region 21 and a side recessed region 23. The first side end region 19 is proximate the first end 10. The second side end region 21 is proximate the second end 28. The side recessed region 23 is between the first and second side end regions 19, 21. The side recessed region 23 is recessed below at least one of the first and second side end region 19, 21. In certain embodiments, the side recessed region 23 is recessed below both the first and second side end region 19, 21.

Using this configuration enables the flint material 24 to be recessed below the first and second side end regions 19, 21 to minimize the potential of the flint material 24 being inadvertently struck while the companion multi-tool 2 is stored or while the companion multi-tool 2 is being used for functionality other than the flint material 24.

Recessing the side recessed region 23 below the first and second side end regions 19, 21 also facilitates accessing the flint material 24 when it is desired to move the flint material 24 from the retracted configuration (FIGS. 1-6) to the extended configuration (FIGS. 7 and 8).

In certain embodiments, the flint material 24 is pivotally mounted to the body 4 to facilitate moving the flint material 24 between the retracted configuration and the extended configuration. When the flint material 24 is in the extended configuration, the flint material 24 is oriented at an angle with respect to the body 4. In certain embodiments, the angle is greater than about 90 degrees. In other embodiments, the angle is between about 90 degrees and about 135 degrees.

The flint material 24 may be removably attached to the body 4. Using such a configuration facilitates detaching the flint material 24 from the body 4 such as when the flint material 24 needs to be replaced. A person of skill in the art will appreciate that a variety of techniques may be used for removably attaching the flint material 24 to the body 4, an example of one suitable attachment technique is a threaded mechanism.

Similarly, the second side 20 includes a first side end region 61, a second side end region 62 and a side recessed region 64. The side first end region 61 is proximate the first end 10. The second side end region 62 is proximate the second end 28. The side recessed region 64 is between the first and second side end regions 61, 62. The side recessed region 64 is recessed below at least one of the first and second side end region 61, 62. In certain embodiments, the side recessed region 64 is recessed below both the first and second side end region 61, 62.

Using this configuration enables the tinder material 22 to be recessed below the first and second side end regions 61, 62 to minimize the potential of the tinder material 22 being inadvertently struck while the companion multi-tool 2 is stored or while the companion multi-tool 2 is being used for functionality other than the tinder material 22.

Recessing the side recessed region 64 below the first and second side end regions 61, 62 also facilitates accessing the tinder material 22 when it is desired to move the tinder material 22 from the retracted configuration (FIGS. 1-6) to the extended configuration (FIGS. 7 and 8).

In certain embodiments, the tinder material 22 is pivotally mounted to the body 4 to facilitate moving the tinder material 22 between the retracted configuration and the extended configuration. When the tinder material 22 is in the extended configuration, the tinder material 22 is oriented at an angle with respect to the body 4. In certain embodiments, the angle is greater than about 90 degrees. In other embodiments, the angle is between about 90 degrees and about 135 degrees.

The tinder material 22 may be removably attached to the body 4. Using such a configuration facilitates detaching the tinder material 22 from the body 4 such as when the tinder material 22 needs to be replaced. A person of skill in the art will appreciate that a variety of techniques may be used for removably attaching the tinder material 22 to the body 4, an example of one suitable attachment technique is a threaded mechanism.

In some embodiments, the body 4 can define one or more accessories, such as, for example, a scraper, a concave blade scoop for cutting fishing line and/or to sharpen sticks, a ruler, and/or any other suitable accessories and/or combination thereof.

In some embodiments, the second end 28 of the body defines noise generating device such as a whistle 30. The whistle 30 includes a mouthpiece 32 and a duct 34, each defined by the body 4.

An opening 36 may be provided in the body 4 at or adjacent to the whistle 30. The opening 36 is sized and configured to receive a retention device therethrough, such as a lanyard, rope, string, and/or other retention device.

Proximate the second end 28, the elongated body 4 may include an end surface 70 that is intermediate a first end edge surface 72 and a second end edge surface 74. The first and second end edge surfaces 72, 74 are both oriented at an obtuse angle with respect to the end surface 70. In certain embodiments, the obtuse angle is between about 90 degrees and about 135 degrees. While it is illustrated that the angle between the end surface 70 and the first end edge surface 72 is approximately the same as the angle between the end surface 70 and the second end edge surface 74, it is possible for these angles to be different.

Orienting the first and second end edge surfaces 72, 74 at an obtuse angle with respect to the end surface 70 reduces a width of the second end 28 that a person needs to put into the person's mouth when using the whistle 30. This configuration enhances the ability for the user to substantially encompass the second end 28 in the person's mouth which enhances the ability of the person to make a loud sound by blowing air through the whistle 30.

Proximate the second end 28, the upper surface 6 and the lower surface 8 may be angled towards each other. This configuration enhances the ability for the user to substantially encompass the second end 28 in the person's mouth which enhances the ability of the person to make a loud sound by blowing air through the whistle 30.

The body 4 can comprise any suitable material. For example, in various embodiments, the body 4 can comprise a die cast metal (aluminum, steel, etc.), a machined metal, a plastic, a rubber, and/or any other suitable material.

The body 4 can define one or more holes, for example, in the first longitudinal surface 6 and/or the second longitudinal surface 8. The one or more holes can include holes sized and configured for receiving a thread, such as paracord, therethrough, hex holes sized and configured to interface with hex bolts/fasteners, and/or any other suitable holes.

In some embodiments, a compass 42 and a reflective surface 44 are coupled to the first longitudinal surface 6. The compass 42 can comprise any suitable compass, such as, for example, a liquid-filled compass. In some embodiments, the compass 42 is at least partially inset into a cavity formed in the first longitudinal surface 6. In some embodiments, a reflective surface 44 is formed on and/or coupled to the first longitudinal surface 6. The reflective surface 44 can comprise a mirrored surface sized and configured to operate as a signal mirror, personal mirror, and/or any other suitable mirror.

In some embodiments, the second longitudinal surface 8 can include one or more accessory elements coupled thereto. In some embodiments, a clip 50 is coupled to the second longitudinal surface 8. The clip 50 can be coupled to the second longitudinal surface by any suitable mechanism, such as, for example, friction (e.g., being inserted into a cavity formed in the second longitudinal surface 8), magnetically, and/or by any other suitable mechanism.

In some embodiments, the clip 50 includes a flat back portion (not shown) coupled to a curved front portion 54. The curved front portion 54 is sized and configured to couple the clip 50 and the body 4 to a belt, pants, and/or any other suitable surface.

In some embodiments, the clip 50 defines one or more holes therethrough. The holes can comprise, for example, hex holes sized and configured to interface with hex fasteners. The clip 50 can comprise any suitable material, such as, for example, a metal material (e.g., steel), a plastic material, and/or any other suitable material.

In some embodiments, the flat back portion defines one or more accessory elements. For example, in the illustrated embodiment, the flat back portion defines a striker 56, a bottle opener 58, and/or a screwdriver 60. The striker 56 includes a blade formed on a lateral edge of the flat back portion. The striker 56 is sized and configured to strike a flint material 24 coupled to the body 4 to provide a spark.

Although embodiments having a striker 56, a can opener 58, and a screwdriver tip 60 are illustrated, it will be appreciated that one or more additional elements can be added and/or one or more of the illustrated elements can be omitted. For example, in some embodiments, the first longitudinal surface 6 and/or the second longitudinal surface 8 can include a markings defining a ruler, a thermometer, and/or any other suitable accessory.

In some embodiments, the clip 50 can be replaced with one or more additional coupling mechanisms, such as, for example, a carabineer clip. The carabineer clip can be permanently and/or releasably coupled to the body 4. In some embodiments, the carabineer clip can define one or more accessories, such as, for example, the striker 56. The carabineer clip can be sized and configured to couple the body 4 to a belt loop, a MOLLE system, and/or any other suitable surface.

Although the systems and devices herein have been described in terms of exemplary embodiments, they are not limited thereto. Rather, the appended claims should be construed broadly, to include other variants and embodiments of the devices, kits, and system, which may be made by those skilled in the art without departing from the scope and range of equivalents of the devices, kits, and systems.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A companion multi-tool comprising:

an elongated body having a first end and a second end, wherein the elongated body comprises a first side and a second side that are both between the first and second ends of the elongated body on opposite edges of the elongated body, wherein the first and second sides each comprise:

a first side end region that is proximate the first end;

a second side end region that is proximate the second end; and a side recessed region between the first and second side end regions, wherein the side recessed region is recessed below at least one of the first and second end regions;

a blade sharpening cavity formed in the elongated body proximate the first end thereof;

a sharpening element attached to the elongated body in the blade sharpening cavity;

a tinder material attached to the elongated body;

a flint material attached to the elongated body;

a noise generating device formed in the elongated body proximate the second end thereof; and a clip attached to the elongated body intermediate the first and second ends.

2. The companion multi-tool of claim 1 wherein the tinder material is operably attached to the elongated body on the first side and wherein the flint material is operably attached to the elongated body on the second side.

3. The companion multi-tool of claim 2, wherein the respective tinder and flint material is recessed below at least part of the first and second end regions when in a retracted configuration.

4. The companion multi-tool of claim 1, wherein the first side has a first cavity formed therein, wherein the first cavity receives at least a portion of the tinder material, wherein the second side has a second cavity formed therein and wherein the second cavity receives at least a portion of the flint material.

5. The companion multi-tool of claim 1, wherein at least one of the tinder and flint materials are pivotally attached to the elongated body for movement between a retracted configuration and an extended configuration.

6. The companion multi-tool of claim 1, wherein at least one of the tinder and flint materials are removably attached to the elongated body.

7. The companion multi-tool of claim 1, wherein the noise generating device is a whistle.

8. The companion multi-tool of claim 1, wherein proximate the first end, the elongated body comprises an end surface that is intermediate a first end edge surface and a second end edge surface, wherein the first and second end edge surfaces are both oriented at an obtuse angle with respect to the end surface.

9. The companion multi-tool of claim 1, wherein proximate the second end, the elongated body comprises an end surface that is intermediate a first end edge surface and a second end edge surface, wherein the first and second end edge surfaces are both oriented at an obtuse angle with respect to the end surface.

10. The companion multi-tool of claim 1, wherein the clip is removably attached to the elongated body, wherein the clip has a recess formed therein for attaching the companion multi-tool to an object and wherein the clip comprises a striker, a bottle opener and a screwdriver.

11. A companion multi-tool comprising:

an elongated body having a first end and a second end, wherein the elongated body comprises a first side and a second side that are both between the first and second ends of the elongated body on opposite edges of the elongated body, wherein the first and second side each comprise:

a first side end region that is proximate the first end;

a second side end region that is proximate the second end; and a side recessed region between the first and second side end regions, wherein the side recessed region is recessed below at least one of the first and second side end regions, a blade sharpening cavity formed in the elongated body proximate the first end thereof;

a sharpening element attached to the elongated body in the blade sharpening cavity;

a tinder material pivotally attached to the elongated body on the first edge surface;

a flint material pivotally attached to the elongated body on the second edge surface; and a noise generating device formed in the elongated body proximate the second end thereof, wherein the respective tinder and flint material is recessed below at least part of the first and second end regions when in a retracted configuration.

12. The companion multi-tool of claim 11 and further comprising a clip attached to the elongated body intermediate the first and second ends.

13. The companion multi-tool of claim 12, wherein the clip is removably attached to the elongated body, wherein the clip has a recess formed therein for attaching the companion multi-tool to an object and wherein the clip comprises a striker, a bottle opener and a screwdriver.

14. The companion multi-tool of claim 11, wherein the first side has a first cavity formed therein, wherein the first cavity receives at least a portion of the tinder material, wherein the second side has a second cavity formed therein and wherein the second cavity receives at least a portion of the flint material.

15. The companion multi-tool of claim 11, wherein the tinder and flint materials are each pivotable with respect to the elongated body a retracted configuration and an extended configuration.

* * * * *